US005251461A

United States Patent [19]

Fallows, III et al.

[11] Patent Number: 5,251,461

[45] Date of Patent: Oct. 12, 1993

[54] GRILLE FOR PACKAGED TERMINAL AIR CONDITIONER

[75] Inventors: Walter J. Fallows, III, Windsor, Mass.; Dennis C. Jones, Clay; John H. Michaels, Baldwinsville, both of N.Y.

[73] Assignee: Carrier Corporation, Syracuse, N.Y.

[21] Appl. No.: 946,701

[22] Filed: Sep. 18, 1992

[51] Int. Cl.[5] ..... F25D 17/06

[52] U.S. Cl. ..... 62/428; 62/452; 454/201

[58] Field of Search ..... 62/428, 452; 165/126; 312/101; 454/201, 224, 241, 243, 245, 246, 247, 248

[56] References Cited

U.S. PATENT DOCUMENTS

| | | | |
|---|---|---|---|
| 2,489,009 | 11/1949 | Corhanidis | 62/428 X |
| 3,388,520 | 6/1968 | Perry | 454/201 X |
| 4,434,710 | 3/1984 | Bolton et al. | 454/201 X |
| 4,976,115 | 12/1990 | Hogan | 62/428 |
| 5,083,443 | 1/1992 | von Blanguer | 62/428 |

*Primary Examiner*—Harold Joyce

[57] ABSTRACT

The baffle for preventing the recirculation of discharged air into the intake grille of a packaged terminal air conditioner is provided with means for attaching it to the grille structure without fasteners. A plurality of flexible fingers with snap latches on the ends thereof are inserted between a pair of spaced ribs on the grille, with the fingers being flexed inwardly during the insertion process and then flexing outwardly to engage the snap latches with a front edge of the vertical ribs when the baffle is in place.

15 Claims, 5 Drawing Sheets

GRILLE FOR PACKAGED TERMINAL AIR CONDITIONER

BACKGROUND OF THE INVENTION

This invention relates generally to air conditioners and, more particularly, to a grille and airflow baffle structure for a packaged terminal air conditioner.

In packaged terminal air conditioners (PTACs), the unit is placed within a wall sleeve and an architectural grille is mounted on the outdoor side, next to the condenser coil. A most common arrangement is to have the outdoor air drawn into the condenser coil by way of the central portion of the grille, and to then discharge the warmed air from the side portions of the grille. With this arrangement, performance losses can occur by a recirculation of the warmed discharged air into the central inlet portion of the grille. In order to prevent this, it is common to provide baffles on either side of the grille central portion to thereby deflect the air that would otherwise tend to be recirculated.

In addition to the function of preventing air recirculation as discussed hereinabove, the baffles have traditionally been employed as handles to be used by the serviceman in installing the grille from the inside of the building. Thus, it is important that the baffle structures be securely fastened to the grille structure. This has been accomplished in the past by various types of fasteners such as screws and the like. While they have been effective, these baffle structures have been expensive, both in terms of materials and time involved in the assembly process.

It is therefore an object of the present invention to provide an improved grille and baffle structure for a packaged terminal air conditioner.

Another object of the present invention is the provision for securely attaching a baffle to a grille without the use of fasteners.

Yet another object of the present invention is the provision for a grille baffle that is economical to manufacture and assemble, while effective in use.

These objects and other advantages become more readily apparent upon reference to the following description when taken in conjunction with the appended drawings.

SUMMARY OF THE INVENTION

Briefly, in accordance with one aspect of the invention, a plastic baffle structure is provided with flexible fingers and snap latches that can function to easily attach the baffle to the grille structure without fasteners. The fingers are so spaced as to be engagable with vertical ribs on the grille to thereby properly locate the baffle on the grille. Snap latches are provided at the end of the fingers to engage the rear side of the grille ribs so as to secure the baffle in its place.

In the drawings as described, a preferred embodiment is depicted; however, various other modifications and alternate constructions can be made thereto without departing from the true spirit and scope of the invention.

DESCRIPTION OF THE PREFERRED EMBODIMENT

Figure 1:
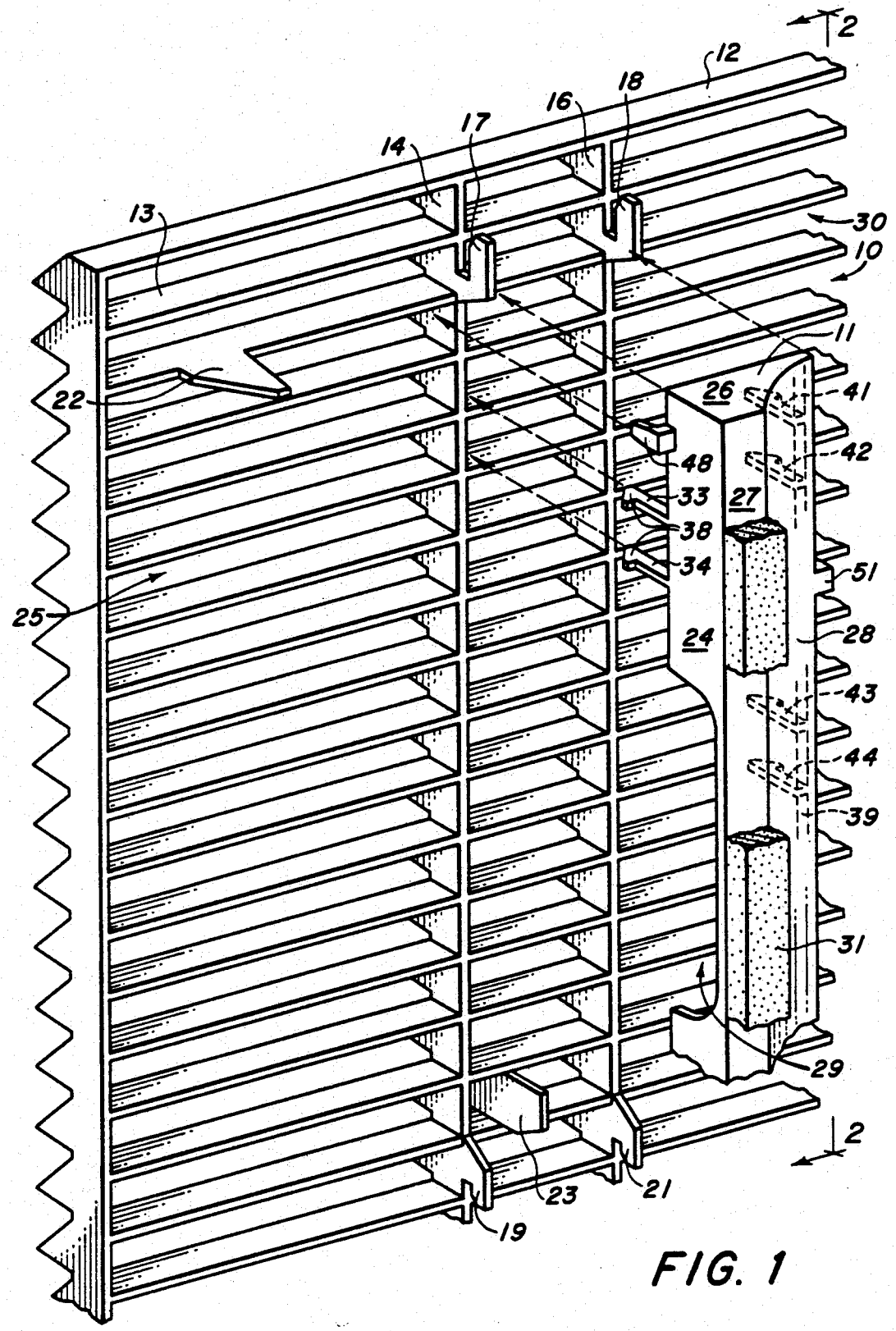
FIG. 1 is a partial exploded view of the baffle and grille in accordance with the present invention.

Referring now to FIG. 1, the invention is shown generally at 10 to include the manner in which a baffle 11 is attached to a PTAC grille 12. The grille 12 comprised of a plurality of horizontal ribs 13 et al. and vertical ribs 14 and 16. Upper arms 17 and 18, and lower arms 19 and 21 are provided to facilitate the installation of the grille 12 to the sleeve structure (not shown) in a manner to be described hereinafter. A horizontal placement tab 22 is provided to assist in alignment of the PTAC unit with the grille 12 as it is subsequently installed into the wall sleeve, behind the grille. A vertical tab 23 and its mate 23' extend from the grille 12 for the purpose of preventing the baffles from being installed in a reversed or inverted position to thereby render them ineffective. This feature will be discussed more fully hereinafter.

The baffle 11 includes a vertically extending sidewall 24, an end wall 26, a rear wall 27, and a sloping, deflecting wall 28. The deflecting wall 28 is intended as a barrier to prevent the recirculation of air that might otherwise occur when the relatively warm air is discharged through a side portion 25 of the grille 12 from the condenser coil located behind the grille. That is, the warm air leaving the side portion 25 might otherwise be drawn into the grille central portion 30 as the fan (not shown) draws air into the condenser coil by way of the grille central portion 30. The deflecting wall, then, substantially reduces this air recirculation phenomena.

The vertical sidewall 24 has a cut-out 29 which permits the baffle 11 to be used as a handle when installing the grille 12 into the wall sleeve. A foam pad 31 is adhesively attached to the rear wall 27 for providing a sealing relationship between the baffle 11 and the front edge of the condenser coil. In this way, the relatively cool airstream passing into the condenser coil by way of the grille central portion 30 is isolated from the relatively warm air that passes from the condenser coil, through the grille side portion 25, to the outside.

The baffle 11 and the grille 12 can be made from any suitable material. However, a preferred material is a light-weight plastic such as a polycarbonate.

Figure 2:
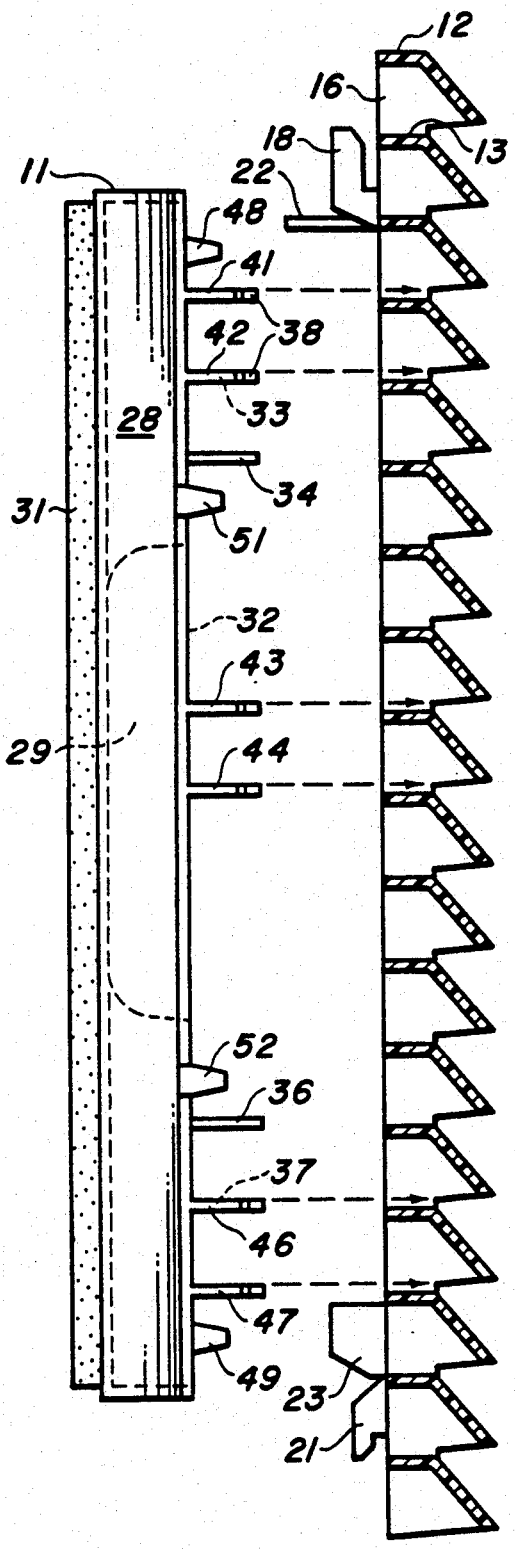
FIG. 2 is a sectional view thereof as seen along Lines 2—2 of FIG. 1.

Referring now to FIGS. 1 and 2, there are shown various appendages to the baffle 11 for attaching the baffle 11 to the grille 12. Attached to and extending forwardly from the front edge 32 of the sidewall 24 are the vertically spaced upper flexible fingers 33 and 34, and vertically spaced lower flexible fingers 36 and 37. As seen in FIG. 1, each of these fingers has a laterally extending snap latch structure 38 at the end thereof. Similarly, attached to and extending forwardly of the front edge 39 of the deflecting wall 28 are the upper 41 and 42, the intermediate 43 and 44, and the lower 46 and 47 flexible fingers, also having snap latches 38 thereon. Each of these fingers interfaces with a vertical rib of the grille 12 when in the installed position. This will be more fully described hereinafter.

Also attached to the sidewall 24, on the side thereof, are a pair of placement flanges 48 and 49, extending outwardly and then forwardly. Similarly, attached to the edge of the deflecting wall 28 are the pair of flanges 51 and 52 that extend outwardly and then forwardly in the same manner. The forwardly extending portions of all of the flanges are bevelled on their inner edges so as to facilitate the easy insertion of the flanges over, and into engaging relationship with, the surfaces of the grille vertical ribs 14 and 16.

Figure 3:
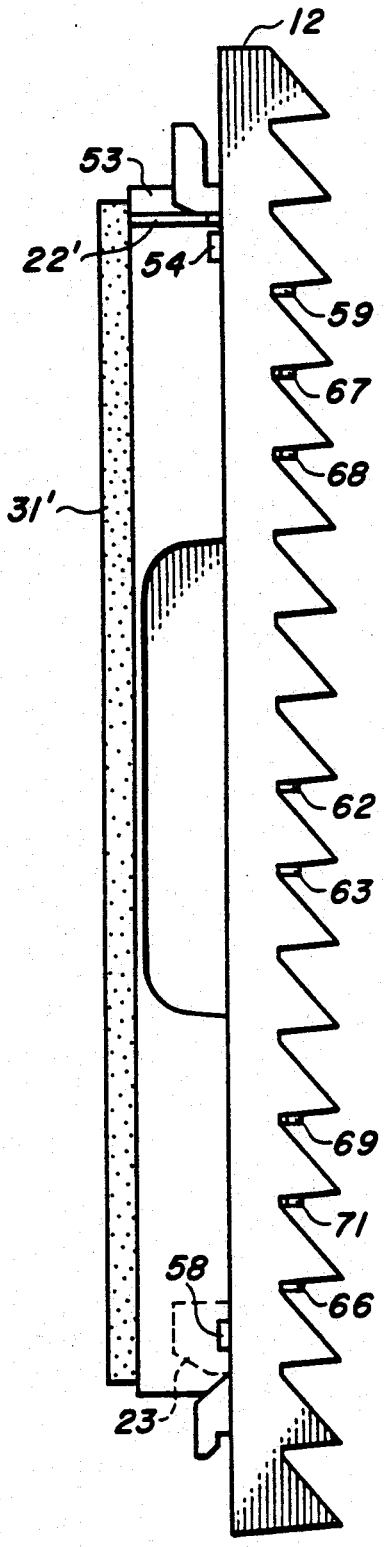
FIG. 3 is a side view of the baffle in its installed position in the grille.
Figure 4:
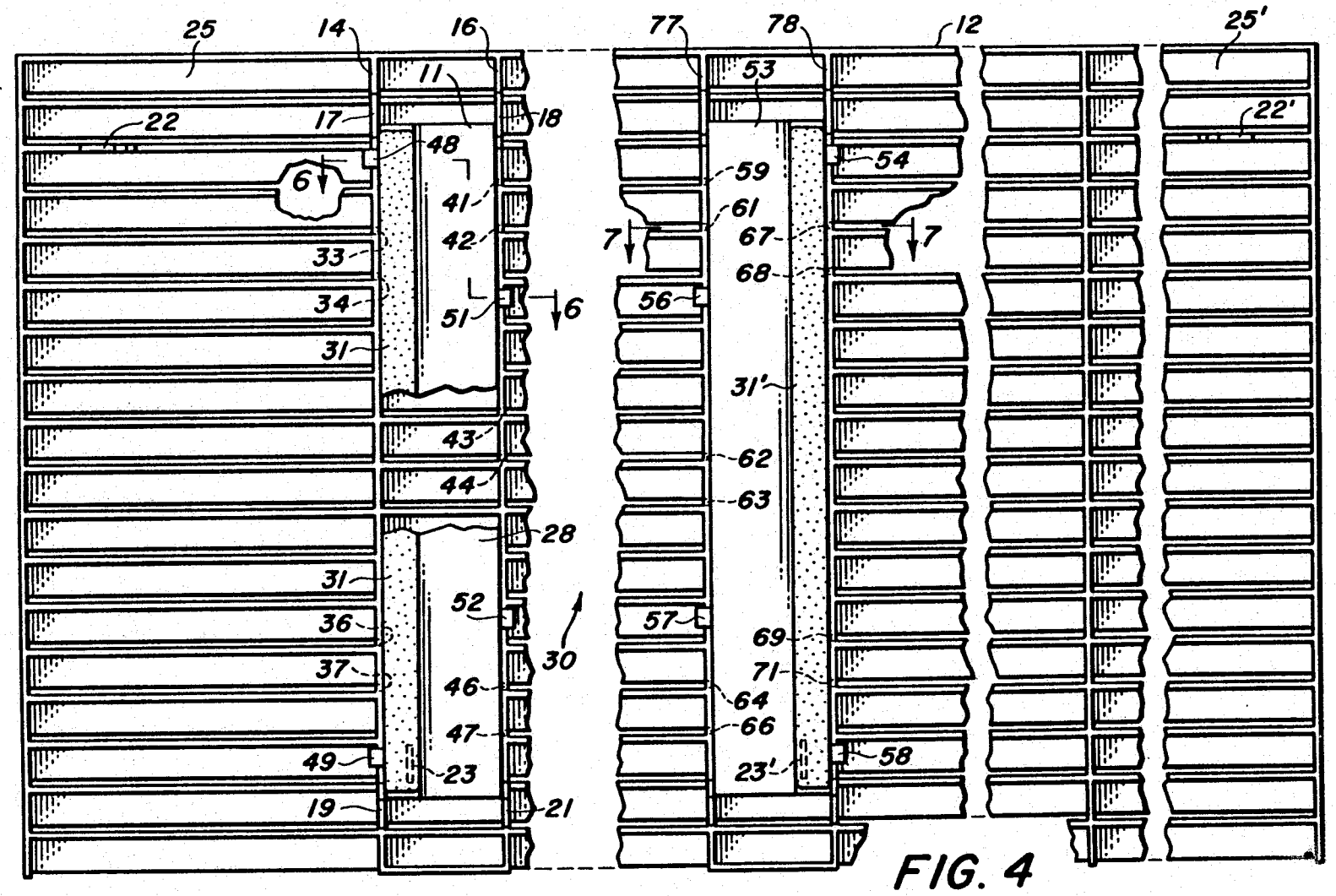
FIG. 4 is a rear view of the grille with the baffles in their installed positions.

As will be seen in FIG. 3 and 4, the baffle 53 to be installed on the other side of the grille central portion 30 is a mirror image of the baffle 11 with flanges 54–58 and fingers 59–71. The vertical tabs 23 and 23' serve no purpose except to prevent the baffles from being installed in the reversed or inverted positions. That is, when installed in their proper positions, the baffles receive the tabs 23 and 23', respectively, into the hollow cavities between the sidewall 24 and the deflecting wall 28. If the baffles are reversed (i.e., with the deflecting walls 28 sloping outwardly rather than inwardly), any attempt to install them would result in an interference between the individual tabs 23 and 23' and the corresponding deflecting wall 28 of the baffle.

Figure 5:
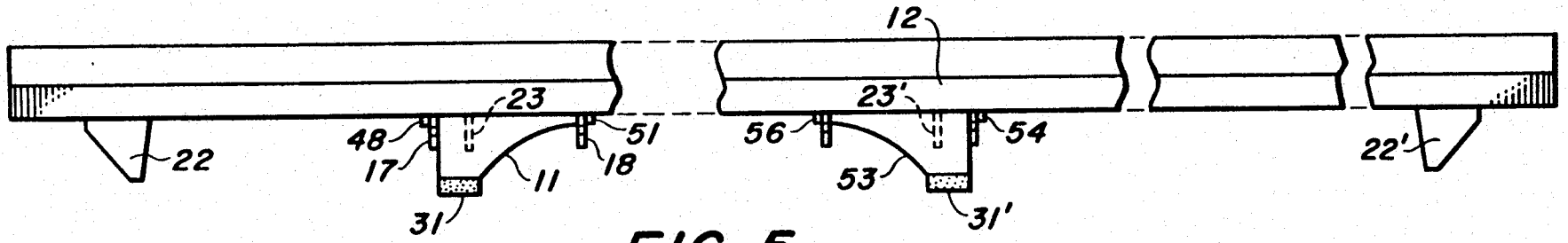
FIG. 5 is a top view thereof.
Figure 7:
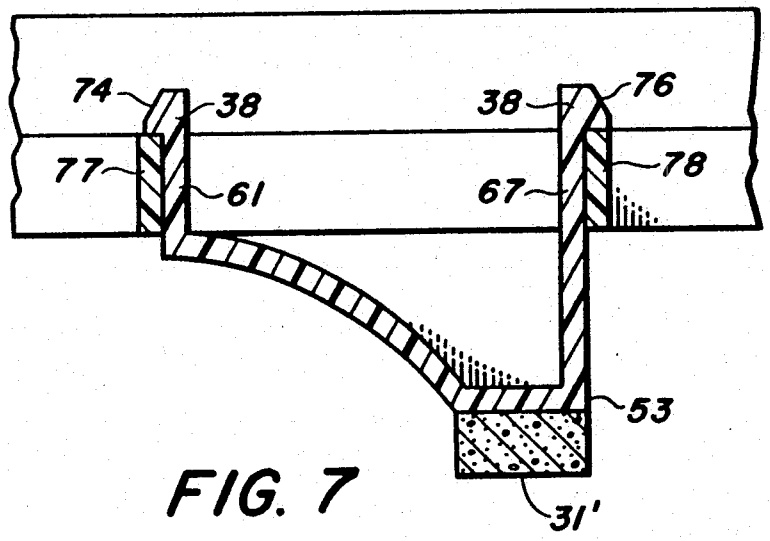
FIG. 7 is a sectional view as seen along Lines 7—7 of FIG. 4.
Figure 6:
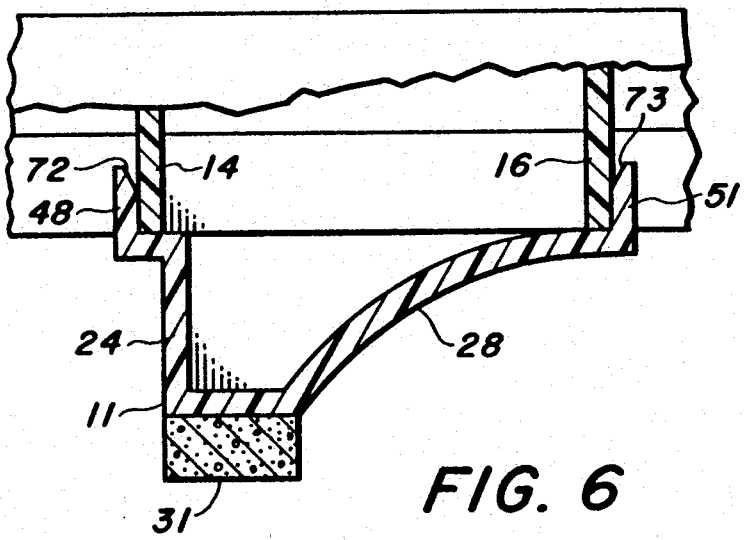
FIG. 6 is a sectional view as seen along Lines 6—6 of FIG. 4.

Having described the structure, the method of assembly will now be described. Shown in FIG. 1, the baffle 11 is lined up with the grille 12 in such a manner that the baffle end wall 26 is under the upper arms 17 and 18, and the flexible fingers and flanges straddle the vertical ribs 14 and 16. That is, the flanges 48 and 49 are positioned on the outer side of the vertical rib 14 and the flanges 51 and 52 are positioned on the outer side of the vertical rib 16, whereas the flexible fingers 33, 34, 36, and 37 are placed on the inner side of vertical rib 14, and the flexible fingers 41, 42, 43, 44, 46 and 47 are placed on the inner side of the vertical rib 16. As will be seen in FIG. 6, the bevelled surfaces 72 and 73 on flanges 48 and 51, and similar bevelled surfaces on the other flanges, allow for easy insertion of the flanges over the vertical ribs 14 and 16. Similarly, there are bevelled surfaces on each of the snap latch structures 38 of the flexible fingers to facilitate insertion of the flexible fingers over the inner surfaces of the vertical ribs 14 and 16. This can be seen in FIG. 7 wherein the snap latches 38 associated with the flexible fingers 61 and 67 have bevelled surfaces 74 and 76 which engage the rear edge of the vertical ribs 77 and 78 to thereby cause the fingers 61 and 67 to flex inwardly and pass over the inner surface of the ribs 77 and 78 to the point that the snap latches 38 have passed to the front side of the vertical ribs 77 and 78. At this time the fingers then again flex outwardly to the installed positions as shown in FIG. 7. The finally installed baffle 53 is shown in FIGS. 3 and 5, and the installed baffle 11 is shown in FIG. 5. The baffles 11 and 53 are thus fully secured to the grille 12 and maintained in position by the snap latches 38, which are engaged with the front surface of the vertical ribs. The baffles 11 and 53 can then be used as handles for installing the grille 12 into position within the wall sleeve 79 as shown in FIG. 8–10.

Figure 8:
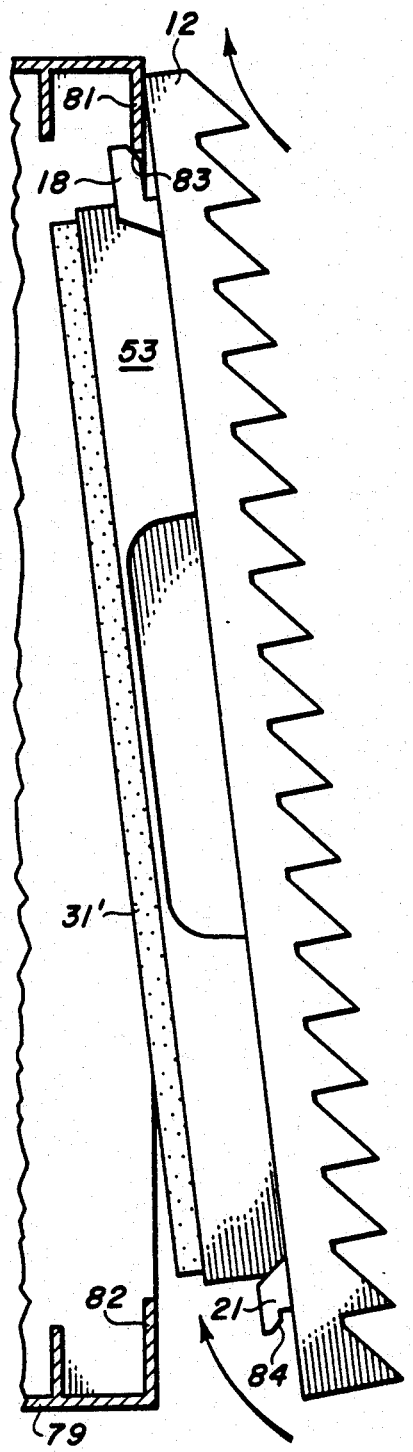
FIGS. 8–10 show the grille in progressive positions of installation within the sleeve structure.
Figure 9:
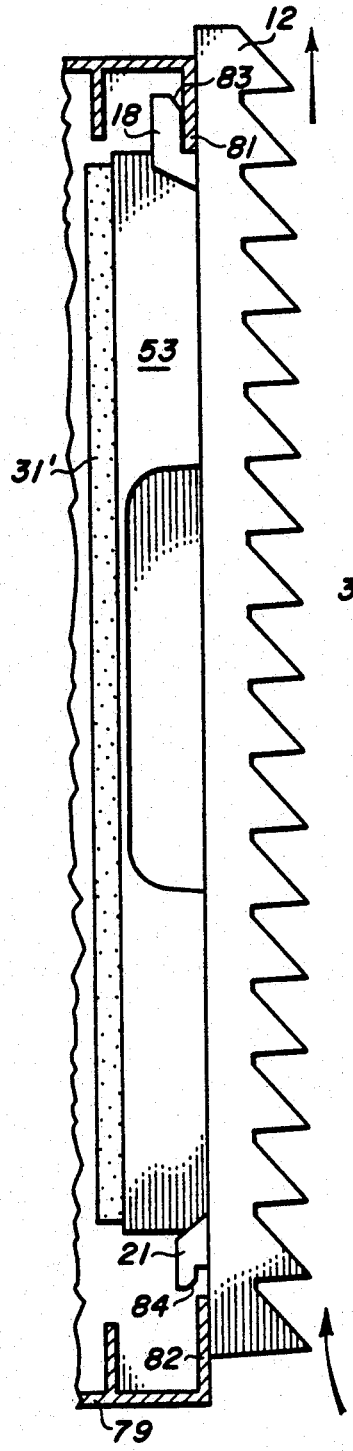
Figure 10:
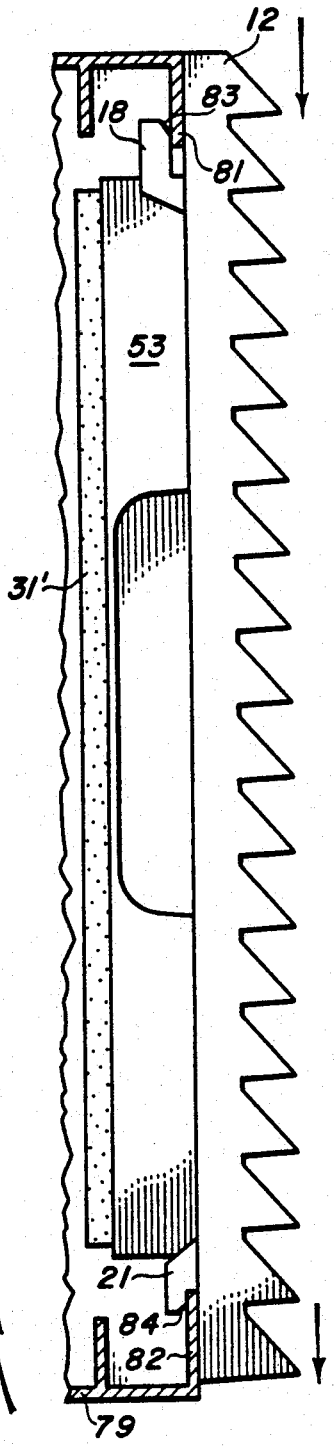

As shown in FIGS. 8–10, the wall sleeve 79, which can be made of suitable material such as metal or plastic, has upper and lower lips 81 and 82 for securing the grille in its installed position. To do so, the installer approaches the sleeve 79 from the inside (on the left of FIG. 8–10), with the grille 12 being held by the baffles 11 and 53. The grille 12 is passed through the sleeve to the outer sides of the upper and lower lips 81 and 82. The grille 12 is then brought back toward the installer, first engaging the upper lip 81 as shown in FIG. 8. A bevelled surface 83 facilitates the easy insertion of the upper arm 18 over the upper lip 81, while the lower end of the grille 12 is then brought into engagement with the lower lip 82 as shown in FIG. 9. Another bevelled surface 84 on the lower arm 29 facilitates the easy insertion of the lower arm 21 over the inner surface of the lower lip 82 as the entire grille is moved downwardly as shown in FIG. 10. The grille 12 is then in its finally installed position.

The PTAC unit can now be installed in its position within the sleeve, with the front edge of the condenser coil being in engaging relationship with the grille 12. As will be seen in FIGS. 1 and 5, the horizontal placement tabs 22 and 22' are provided to laterally align the grille 12 with the sleeve. As the coil is then brought up into place, its outer edges come into engagement with the foam pads 31 and 31' to thereby isolate the outer face of the coil from the side portions 25 and 25'. The baffles 11 and 53 function to prevent recirculation of the air as described hereinabove.

While the present invention has been disclosed with particular reference to a preferred embodiment, the concepts of this invention are readily adaptable to other embodiments, and those skilled in the art may vary the structure and/or method thereof without departing from the essential spirit of the invention.

What is claimed is:

1. An improved grille and baffle structure for an air conditioner of a type having a central portion for receiving outdoor air to be recirculated through a coil and then discharged through side portions of the grille, wherein the improvement comprises:

a grille having vertical ribs for separating the central portion from a side portion of the grille;

a baffle for placement on the rear side of said grille, in alignment with said vertical ribs, the baffle having a sloping surface to inhibit the flow of discharged air into the grille central portion; and a plurality of flexible fingers attached to and extending from said baffle and engagable with sides of said vertical ribs to secure said baffle to said grille.

2. An improved grille and baffle structure as set forth in claim 1 wherein each of said flexible fingers has a snap latch on the end thereof for engaging a front surface of one of said vertical ribs.

3. An improved grille and baffle structure as set forth in claim 1 wherein said flexible fingers are so disposed as to be insertable between said pair of vertical ribs.

4. An improved grille and baffle structure as set forth in claim 3 wherein each of said flexible fingers has a laterally extending snap latch at the end thereof for engaging a surface of one of said vertical ribs.

5. An improved grille and baffle structure as set forth in claim 4 wherein said snap latch engages a front edge of one of said vertical ribs.

6. An improved grille and baffle structure as set forth in claim 1 and including a plurality of retainer flanges attached to and extending from said baffle and engagable with a side of one of said vertical ribs opposite the side on which said flexible fingers are disposed.

7. An improved grille and baffle structure as set forth in claim 6 wherein each of said plurality of retainer flanges has a bevelled surface thereon to facilitate the easy insertion of the retainer flange into position at said side of said vertical rib.

8. An improved grille and baffle structure as set forth in claim 2 wherein each of said flexible finger snap latches has a bevelled surface thereon for engagement with a rear edge of one of said vertical ribs to facilitate the flexing of said flexible finger to thereby permit the advancement of the snap latch into its final position.

9. An improved grille and baffle structure as set forth in claim 1 and including at least one tab extending rearwardly from the grille and being in such a position as to prevent said baffle from being installed when in an inverted position.

10. An improved baffle structure for a grille of an air conditioning unit of the type having a fan for drawing outside air into a central portion of the grille and discharging air from the side portions thereof, wherein the improvement comprises:

a baffle body for placement on the rear side of the grille and having a vertically extending sidewall and a sloping, deflecting wall;

at least a pair of vertically spaced flexible finger members attached to and extending forwardly from a front edge of said sidewall, said finger members being positionable against a first vertical rib of the grille;

at least a pair of vertically spaced flexible finger members attached to and extending forwardly from a front edge of said deflecting wall, said finger members being positionable against a second vertical rib of the grille; and a snap latch formed on each of said sidewall and deflecting wall flexible fingers for engaging a front edge of said respective first and second grille vertical ribs.

11. An improved baffle structure as set forth in claim 10, wherein said snap latches each have a beveled surface for engaging a rear edge of one of said vertical ribs to facilitate the flexing of one of said flexible fingers.

12. An improved baffle structure as set forth in claim 10, wherein said side wall and deflecting wall flexible fingers are so disposed as to be insertable between said first and second vertical ribs.

13. An improved baffle structure as set forth in claim 10 and including a plurality of retainer flanges attached to and extending from each of said vertically extending side and deflecting walls and engagable with a side of one of said vertical ribs opposite the side on which said flexible fingers are disposed.

14. An improved baffle structure as set forth in claim 13, wherein each of said plurality of retainer flanges has a beveled surface thereon to facilitate the easy insertion of the retainer flange into position at said side of said vertical ribs.

15. An improved baffle structure as set forth in claim 10, wherein each of said plurality of flexible finger snap latches has a beveled surface thereon for engagement with a rear edge of one of said vertical ribs to facilitate the flexing of said flexible finger to thereby permit the advancement of the snap latch into its final position.

* * * * *